US006705139B2

(12) United States Patent
Tsai

(10) Patent No.: US 6,705,139 B2
(45) Date of Patent: Mar. 16, 2004

(54) MAGNETIC LOCK MECHANISM

(76) Inventor: Lincoln Tsai, 3117 Adelia Ave., #32, El Monte, CA (US) 91733

( * ) Notice: Subject to any disclaimer, the term of this patent is extended or adjusted under 35 U.S.C. 154(b) by 112 days.

(21) Appl. No.: 09/882,445

(22) Filed: Jun. 15, 2001

(65) Prior Publication Data

US 2002/0189306 A1 Dec. 19, 2002

(51) Int. Cl.[7] ..... E05B 47/00
(52) U.S. Cl. ..... 70/276; 70/413
(58) Field of Search ..... 70/276, 413, 388

(56) References Cited

U.S. PATENT DOCUMENTS

| | | | | | |
|---|---|---|---|---|---|
| 2,628,729 | A | * | 8/1953 | Noregaard | 70/276 X |
| 3,393,541 | A | * | 7/1968 | Wake | 70/276 |
| 3,408,837 | A | * | 11/1968 | Felson | 70/276 |
| 3,416,336 | A | * | 12/1968 | Felson | 70/276 |
| 3,512,382 | A | * | 5/1970 | Check et al. | 70/276 |
| 3,566,637 | A | * | 3/1971 | Hallmann | 70/276 |
| 3,584,484 | A | * | 6/1971 | Hallmann | 70/276 |
| 3,661,001 | A | * | 5/1972 | Glass | 70/388 |
| 3,665,740 | A | * | 5/1972 | Taniyama | 70/276 |
| 3,995,463 | A | * | 12/1976 | Mikos | 70/388 |
| 4,228,667 | A | * | 10/1980 | Herriott | 70/276 |
| 4,380,162 | A | * | 4/1983 | Woolfson | 70/276 |
| 4,416,127 | A | * | 11/1983 | Gomez-Olea Naveda | 70/276 |
| 4,562,711 | A | * | 1/1986 | Fliege | 70/276 |
| 4,748,834 | A | * | 6/1988 | Herriott | 70/413 |
| 4,841,758 | A | * | 6/1989 | Ramblier | 70/276 |
| 5,193,371 | A | * | 3/1993 | Yamane | 70/276 |
| 6,041,628 | A | * | 3/2000 | Lin | 70/276 |
| 6,367,297 | B1 | * | 4/2002 | Mottura | 70/276 |

* cited by examiner

*Primary Examiner*—Suzanne Dino Barrett

(57) ABSTRACT

A magnetic lock mechanism includes a magnetic lock cylinder for actuating a latch assembly. The magnetic lock cylinder includes a plurality of tumbler sockets radially distributed on an inner surface of the lock sleeve. A plurality of magnet tumblers are coaxially placed in the tumbler sockets respectively. A tubular lock rotor is rotatably and coaxially fitted in an axial rotor hole of the lock sleeve. The lock rotor has a plurality of locking holes radially distributed through a rotor wall thereof. A locker tube, having a plurality of through slots, is fittedly disposed inside an axial through hole of the lock rotor to define a keyway therethrough. A magnetic key includes a round key body and a plurality of magnets provided around the key body corresponding to the axial and radial positions of the magnet tumblers in the magnetic lock cylinder respectively.

20 Claims, 6 Drawing Sheets

MAGNETIC LOCK MECHANISM

BACKGROUND OF THE PRESENT INVENTION

1. Field of Invention

The present invention relates to lock and key, and more particularly to a magnetic lock mechanism comprising a magnetic lock cylinder associated with a magnetic key to provide more locking permutations and combinations. Thus, a locker tube having a plurality of through slots adapted for directly attracting magnet tumblers of a magnetic lock cylinder while being magnetically attraction effective.

2. Description of Related Arts

The conventional lock and key assembly, such as barrel lock, utilizes specific engagement or disengagement between a plurality of pin-tumblers in the lock cylinder and the key's serration correspondingly to control the locking and unlocking functions thereof.

Virtually all mechanical locking devices are subject to tampering, possibly resulting from loss of keys, duplication of keys, and picking due to its limited mechanical structure and theory. Moreover, although many types of locking devices which are magnetically actuated or controlled are known in arts, they all bear a common drawback of failing to ensure all the magnet tumblers precisely returning to their locking position when the key is withdrawn from the keyway. Such unsolved problem is the main reason of why the magnetic lock cannot be commonly on sale in market and broadly utilized by the consumers.

SUMMARY OF THE PRESENT INVENTION

A main object of the present invention is to provide a magnetic lock mechanism which avoids the drawbacks of easy picking and key duplicating of the conventional mechanical lock and key assembly by eliminating the serrations of the keys with a simply rod like magnetic key to associate with a mechanical lock cylinder by fitting into a circular keyway thereof.

Another object of the present invention is to provide a magnetic lock mechanism wherein the arrangement of the magnet tumblers, which is not limited to one or two opposing rows as in the mechanical lock and key assembly, can include any possible number of tumblers aligned around anywhere of the entire cylindrical surface of the key and keyway correspondingly, so that the present invention can provide more locking permutations and combinations to ensure the security function of a lock.

Another object of the present invention is to provide a magnetic lock mechanism wherein all the magnet tumblers inside the magnetic lock cylinder will be guided to rapidly and precisely return to their locking positions once the magnetic key is withdrawn from the keyway of the magnetic lock cylinder.

Another object of the present invention is to provide a magnetic lock mechanism wherein all the magnet tumblers inside the magnetic lock cylinder will be guided to rapidly and precisely radially move to their unlocking positions once the magnetic key is inserted into the keyway of the magnetic lock cylinder.

Accordingly, in order to accomplish the above objects, the present invention provides a magnetic lock mechanism, comprising:

a magnetic lock cylinder for actuating a latch assembly, wherein the magnetic lock cylinder comprises a lock sleeve, made of non-magnetic material such as brass, having an axial rotor hole and a plurality of tumbler sockets radially distributed on an inner surface of the lock sleeve;

a plurality of magnet tumblers, each of which has a north pole and a south pole at two ends respectively, being coaxially placed in the tumbler sockets respectively, wherein each of the magnet tumblers must be equal to or shorter than the respective tumbler socket of the lock sleeve;

a tubular lock rotor, made of non-magnetic material, being rotatably and coaxially fitted in the axial hole of the lock sleeve, the lock rotor having an axial through hole and a plurality of locking holes radially distributed through a rotor wall thereof, wherein the locking holes are adapted for being coaxially aligned with the tumbler sockets respectively and each of the locking holes has a depth shorter than a length of the respective magnet tumbler; and a locker tube having a plurality of through slots, made of magnetic conducting material such as iron and steel, being fittedly disposed inside the axial through hole of the lock rotor to define a keyway therethrough, wherein the locker tube is adapted for attaching the magnet tumblers inside the rotor hole to move inwardly towards the locking hole until an inner portion of each of magnet tumblers is disposed in the respective locking hole and an outer portion of each of the magnet tumblers is disposed in the respective rotor socket so as to lock up the rotatable movement between the lock rotor and the lock sleeve; and a magnetic key comprising a key body having a plurality of magnet sockets provided around the key body corresponding to the axial and radial positions of the magnet tumblers in the magnetic lock cylinder respectively, and a plurality of pill shaped magnets affixed in the magnet sockets respectively, wherein an outer end of each of the magnets has a magnetic pole equal to the magnet pole of the respective magnet tumbler, so that when the magnetic key is inserted into the keyway, the magnet tumblers are repelled radially outward into the tumbler sockets correspondingly, so as to unlock the magnetic lock cylinder to enable the lock rotor freely rotating to control the locking and unlocking of the latch assembly.

DETAILED DESCRIPTION OF THE PREFERRED EMBODIMENT

Figure 1:
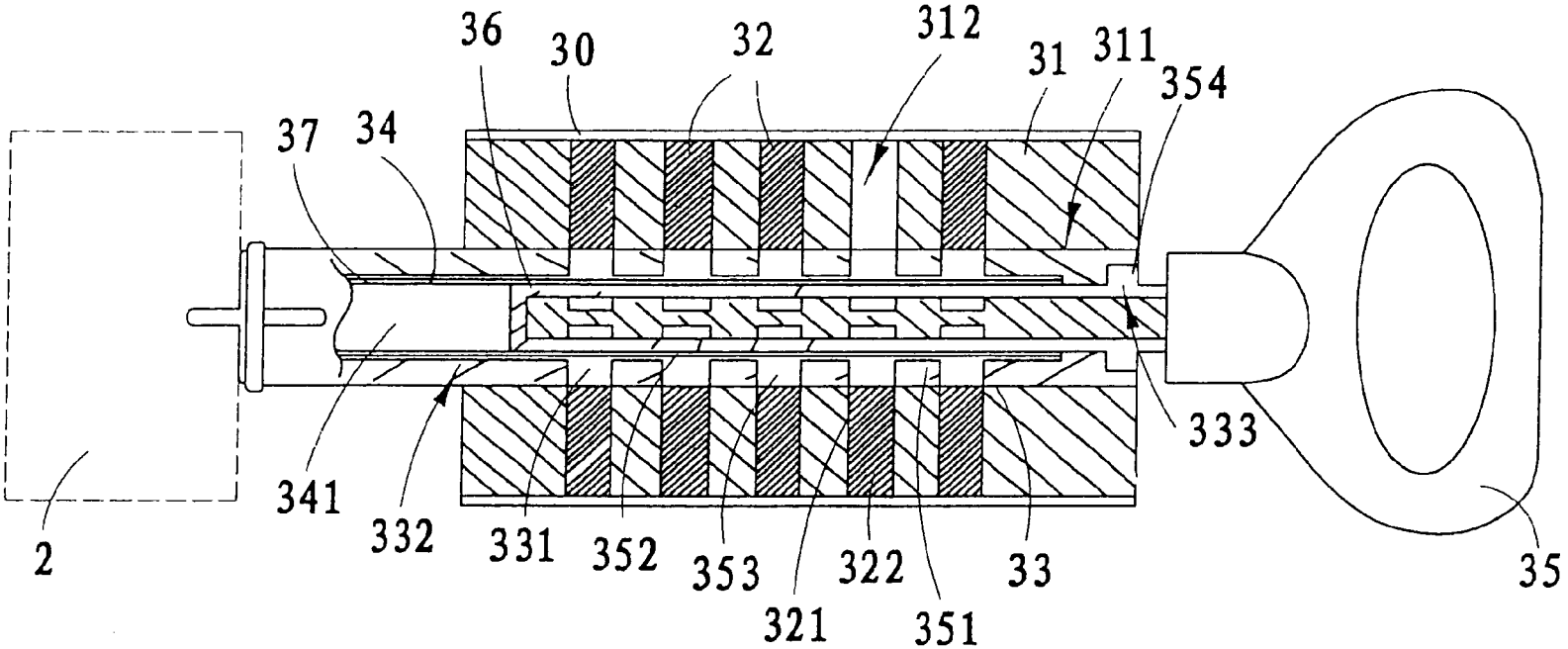
FIG. 1 is a sectional front view of a magnetic lock mechanism according to a first preferred embodiment of the present invention.
Figure 2:
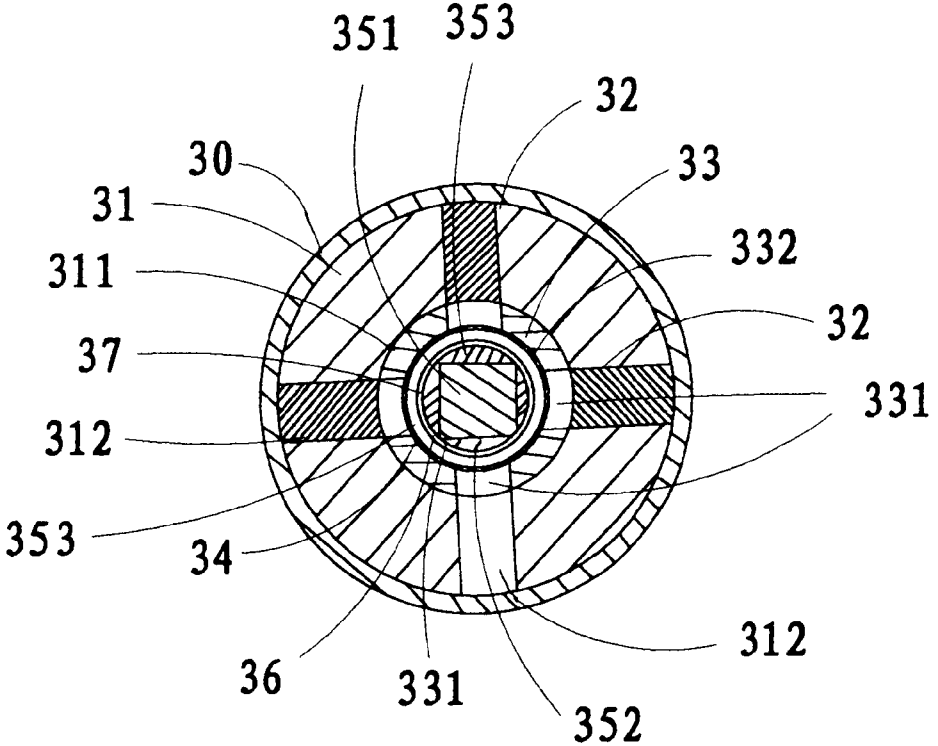
FIG. 2 is a sectional end view of the magnetic lock mechanism according to the above first preferred embodiment of the present invention.

Referring to FIGS. 1 and 2 of the drawings, a magnetic lock mechanism 10 according to a first preferred embodiment of the present invention is illustrated. The magnetic lock mechanism 10 comprises a magnetic lock cylinder 30 adapted for actuating a latch assembly 2 and a magnetic key 35.

The magnetic lock cylinder 30 comprises a lock sleeve 31, a plurality of magnet tumblers 32, a tubular lock rotor 33, and a locker tube 34.

The lock sleeve 31, which is made of non-magnetic material such as brass, has an axial rotor hole 311 and a plurality of tumbler sockets 312 radially distributed on an inner surface of the lock sleeve 31.

The plurality of magnet tumblers 32, each of which has a north pole 321 and a south pole 322 at two ends respectively, are coaxially placed in the tumbler sockets 312 respectively, wherein each of the magnet tumblers 32 must be equal or shorter than the respective tumbler socket 312 of the lock sleeve 31.

The tubular lock rotor 33, which is made of non-magnetic material, is rotatably and coaxially fitted in the axial rotor hole 311 of the lock sleeve 31, the lock rotor 33 having an axial through hole 332 and a plurality of locking holes 331 distributed radially through a rotor wall thereof, wherein the locking holes 331 are adapted for being aligned with the tumbler sockets 312 respectively and each of the locking holes 331 has a depth shorter than a length of the respective magnet tumbler 32.

The locker tube 34, which is made of magnetic conducting material such as iron and steel, is fittedly disposed inside the axial through hole 322 of the lock rotor 33, wherein the locker tube 34 is adapted for attracting the magnet tumblers 32 inside the rotor hole 311 to move inwardly towards the locking hole 331 until an inner portion of each of magnet tumblers 32 is disposed in the respective locking hole 331 and an outer portion of each of the magnet tumblers 32 is disposed in the respective tumbler socket 312 so as to lock up the rotatable movement of the lock rotor 33 with respect to the lock sleeve 31.

Figure 3:
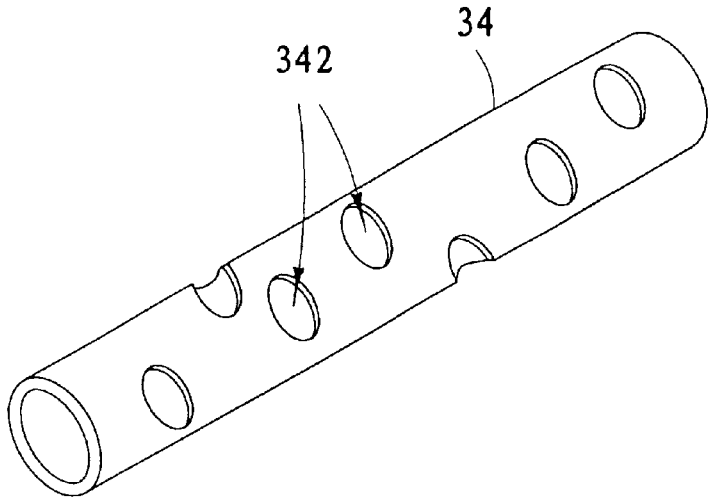
FIG. 3 is a perspective view of a locker tube of the magnetic lock mechanism according to the above first preferred embodiment of the present invention.

As shown in FIG. 3, the locker tube 34 has a plurality of through slots 342 axially and selectively provided thereon wherein each through slot 342 is aligned with the respective locking hole 331 of the lock rotor 33. A size of each of the through slots 342 of the locker tube 34 is larger than a diameter of the locking hole 331 of the lock rotor 33 such that the magnet tumblers 32 are adapted for passing through the through slots 342 respectively.

Figure 4:
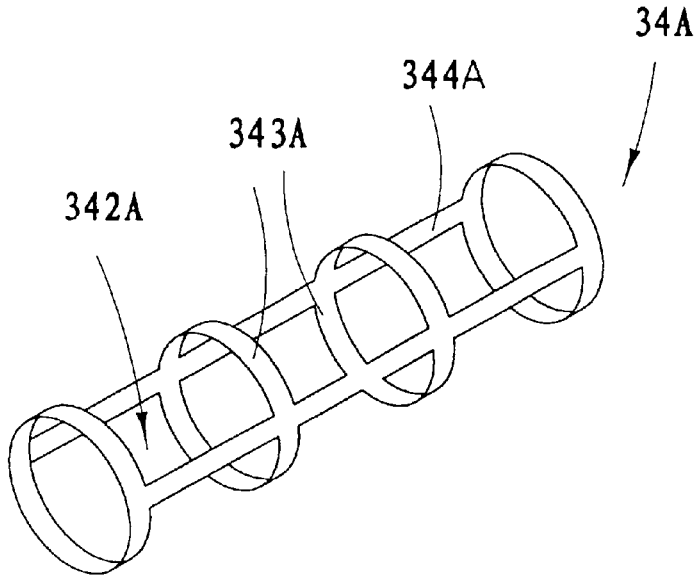
FIG. 4 illustrates a first alternative mode of the locker tube of the magnetic lock mechanism according to the above first preferred embodiment of the present invention.

FIG. 4 illustrates a first alternative mode of the locker tube 34A of the magnetic lock mechanism 10 wherein the locker tube 34A comprises a plurality of ring-shaped tube members 343A spacedly and coaxially aligned with each other and at least a supporting arm 344A integrally connected between two tube members 343A so as to define a through slot 342A between two tube members 343A.

Figure 5:
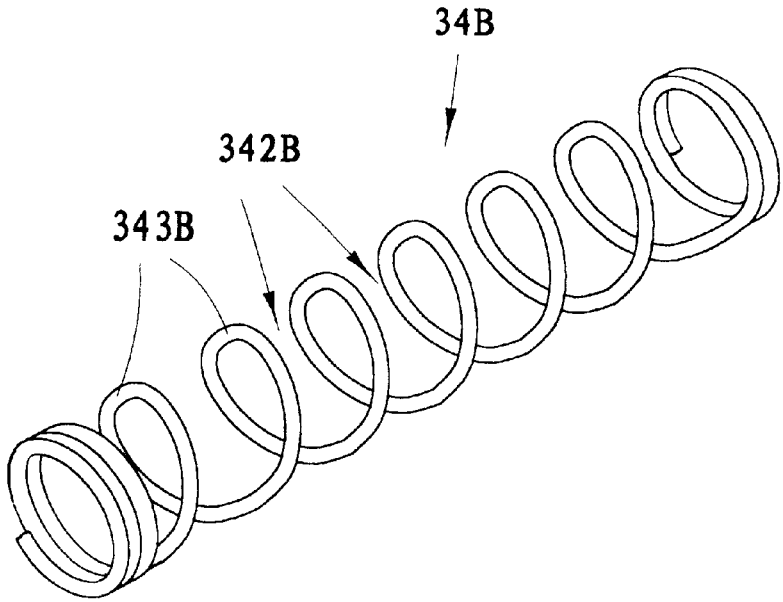
FIG. 5 illustrates a second alternative mode of the locker tube of the magnetic lock mechanism according to the above first preferred embodiment of the present invention.

FIG. 5 illustrates a second alternative mode of the locker tube 34B of the magnetic locker assembly 10 wherein the locker tube 34B comprises a c oil tube body 343B integrally extended in a spiral manner such that the through slots 342B are formed gaps between the coil tube body 343B.

Figure 6:
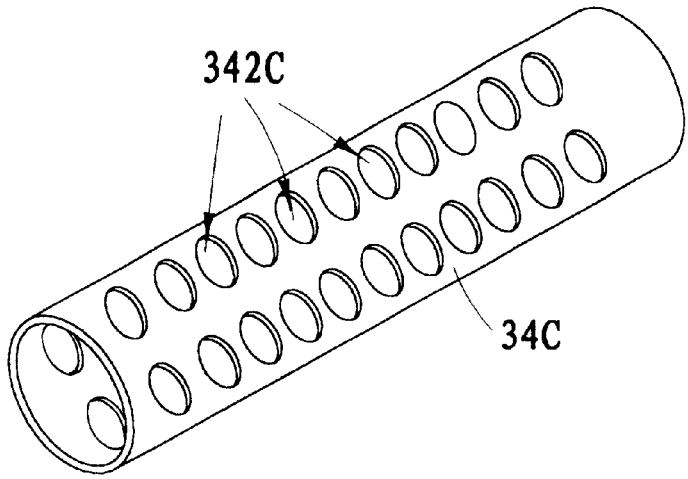
FIG. 6 illustrated a third alternative mode of the locker tube of the magnetic lock mechanism according to the above first preferred embodiment of the present invention.

FIG. 6 illustrates a third alternative mode of the locker tube 34C of the magnetic locker assembly 10 wherein a maximum numbers of through slot 342C are already radially distributed through the locker tube 34C so as to provide an universal locker tube 34C for a 11 axial and radial positions of the magnet tumblers 32 of the magnetic lock cylinder 30.

The magnetic lock cylinder 30 further comprises an interior cover tube 37, which is made of non-magnetic material, is coaxially and fittedly disposed in the locker tube 34 to define a keyway 341 therethrough for securely covering the locker tube 34 wherein the magnet tumblers 32 are adapted for sitting on the interior cover tube 343 by magnetically attracting the magnet tumblers 32 with the locker tube 34 through the through slots 342 respectively.

The magnetic key 35 comprises a round rod shaped key body 351 which has a plurality of magnet sockets 352 provided around the key body 351 corresponding to the axial and radial positions of the magnet tumblers 32 in the magnetic lock cylinder 30 respectively, and a plurality of pill shaped magnets 353 affixed in the magnet sockets 352 respectively. An outer end of each of the magnets 353 has a magnetic pole equal to the magnetic pole of the respective magnet tumbler 33, so that when the magnetic key 35 is inserted into the keyway 341, the magnet tumblers 33 are repelled radially outward into the tumbler sockets 312 correspondingly, so as to unlock the magnetic lock cylinder 30 to enable the lock rotor 33 freely rotating to control the locking and unlocking of the latch assembly 2.

The magnetic key 35 further comprises an exterior cover tube 36 to securely and entirely cover the key body 351 therein coaxially, so that the locations of all the magnets 353 affixed on the magnet sockets 352 is hidden from outside observation for security purpose. In fact, although each magnetic key 35 can only operate a corresponding magnetic lock cylinder 30, all magnetic keys 35 may have an identical appearance of merely a round rod. The user may simply use color of other indications to distinguish the keys of different locks easily.

Moreover, each of the magnet tumblers 312 and the respective magnet 353 should be coaxially aligned in a perpendicular manner with the axis of keyway 341 of the magnetic lock cylinder 30.

An open end of the lock rotor 30 has a locating groove 333 formed thereon. A locating latch 354 is outwardly protruded from an inner end of the key body 351 of the magnetic key 35, which is adapted to serve not only locating the magnets 353 inside the magnetic key 35 corresponding to the magnet tumblers 32 in the magnetic lock cylinder 30 but also predetermining the length of the magnet key 35 that should be inserted into the keyway 341. Moreover, the locating latch 354 inserting into the locating groove 333 serves for easing rotation of the lock rotor 33 while in an unlocking condition.

The operation of the magnetic lock assembly 10 is all about the magnet field. A predetermined combination of the magnet tumblers 32 is located at the respective locking hole 331. It means that the location and the pole (the north and the south pole) of the magnet tumbler 32 can be selected and placed on the locking hole 331. This arrangement of the magnet tumbler 32 is set as a locking code for the magnetic lock assemble 10. If the magnetic key 35 has the corresponding arrangement and pole of the magnet 353 on the key body 351, the magnetic key 35 is adapted for unlocking the lock rotor 33. When the magnetic key is inserted into the respective lock cylinder 30, because of the magnetic properties of "Like poles repel, unlike poles attract", the magnet tumblers 32 are repelled by the respective magnet 353 on the magnetic key 35 radially outward into the tumbler sockets 312 correspondingly, so as to unlock the magnetic lock cylinder 30 to enable the lock rotor 33 freely rotating to control the locking and unlocking of the latch assembly 2. When the magnetic key 35 is pulled out of the keyway 341, the magnetic field disappears and the isolated magnet tumblers 32 will be magnetically attracted by the conductive locker tube 34 and seat on the interior cover tube 37, so as to return to their original arranged locking holes 331 in such a lock-up position.

Otherwise, if the magnetic key 35 is inserted into a non-corresponded lock cylinder 30, which one of the magnets 353 inside the magnetic key 35 is in different arrangement or has an unlike pole to the magnet tumbler 32, the magnet tumbler 32 is either seated or forced to stay on the locking hole 331 of the lock rotor 33 because of the attractive force of the unlike poles. So, the magnet tumblers 32 act as a latch to lock the rotation of the lock rotor 32 and keep in the locking condition. Accordingly, the more magnet tumblers 32 placed in the lock cylinder 30, the more the security of magnetic lock mechanism is. It is because when the number of magnet tumbler 32 placed in the lock cylinder 30 increases, the more combination of the locking code is received.

It is worth it to mention that the magnets 353 of the magnetic key 35 can directly repel the magnet tumblers 32 of the magnetic lock cylinder 30 through the through slot 342 of the locker tube 34. When there is no through slot 342 on the locker tube 34, the attraction force between the magnet tumblers 32 and the locker tube 34 will reduce the repelling force between the magnet tumblers 32 and the magnets 353, which may effect the unlocking position of the magnet tumblers 32 of the magnetic lock mechanism 10.

Figure 7:
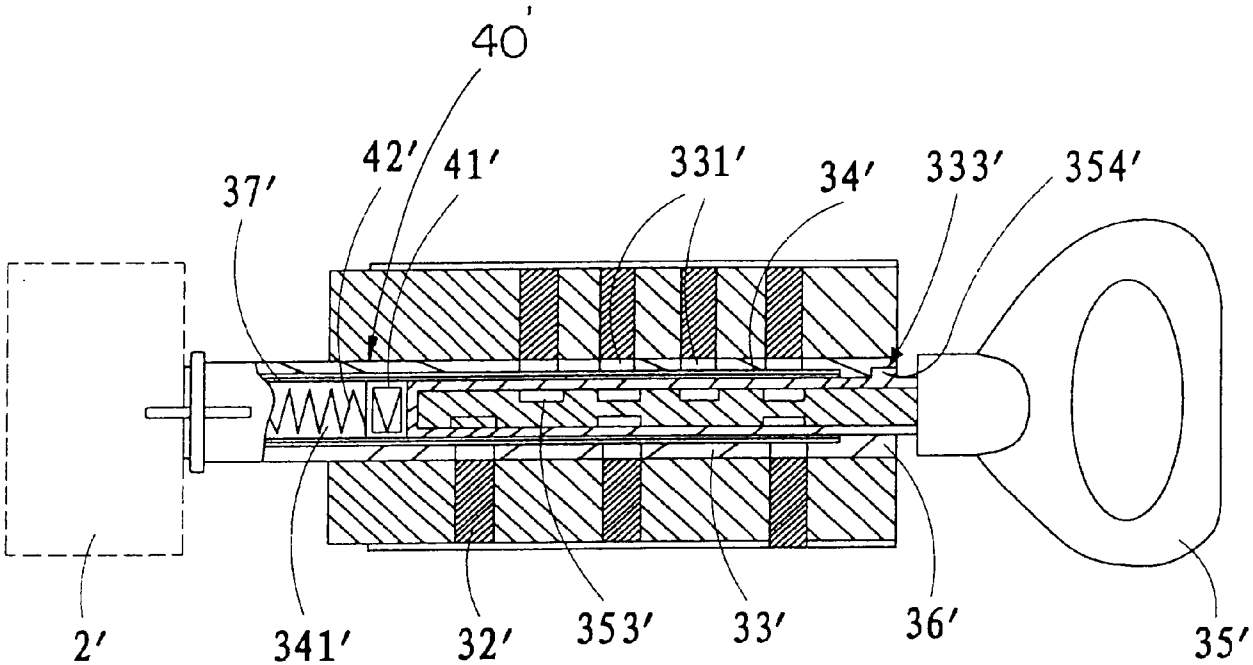
FIG. 7 is a sectional front view of a magnetic lock mechanism when the magnetic key is inserted into the circular keyway according to a second preferred embodiment of the present invention.
Figure 8:
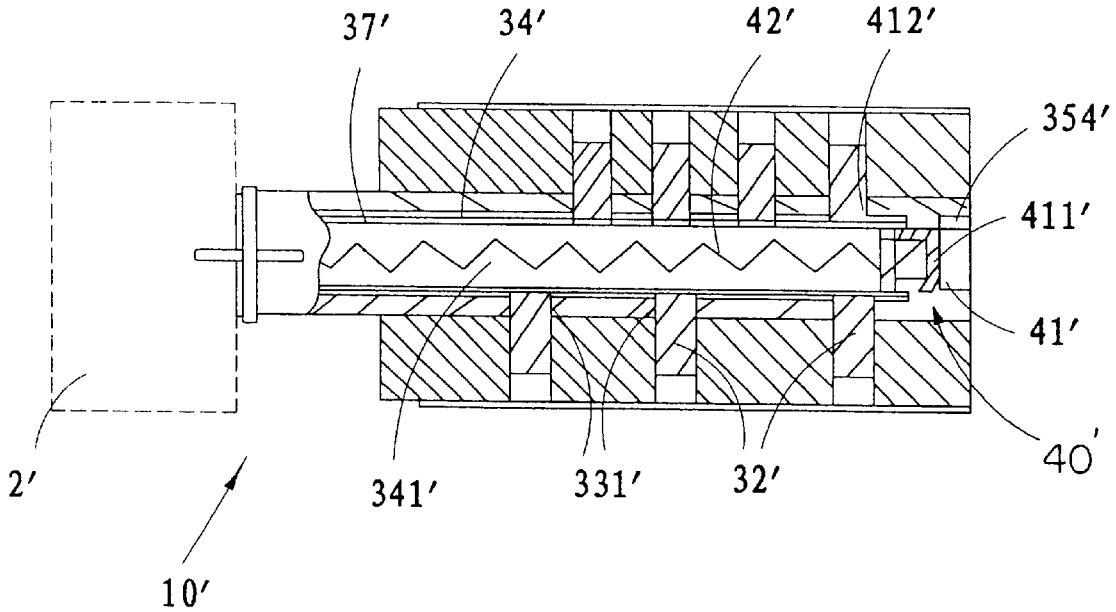
FIG. 8 is a second front view of an empty magnetic lock cylinder of the magnetic key lock assembly without the magnetic key in the circular keyway thereof according to the above second preferred embodiment of the present invention.
Figure 9:
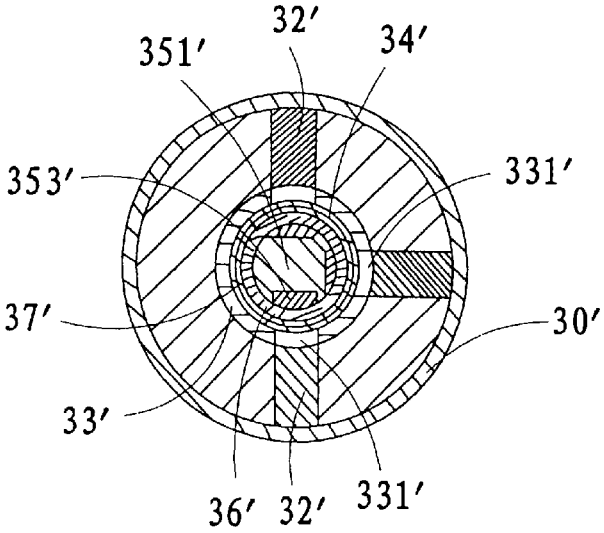
FIG. 9 is a sectional end view of the magnetic lock mechanism according to he above second preferred embodiment of the present invention.

Referring to FIGS. 7 through 9 of the drawings, a second preferred embodiment of the magnetic lock mechanism 10' is illustrated, which basically has similar configuration as the above first embodiment. The locking holes 331' are only necessarily mounted on the rotor wall corresponded to the number of the magnet tumblers 32'. The magnetic lock mechanism 10' further comprises a returning means 40', which further comprises a cap 41' having a diameter smaller than the diameter of the keyway 341' and a resilient element 42, which is a spring, inserting into the keyway 341'. The cap 41' is adapted for sliding along the keyway 341' and comprises a cap body 411' for the resilient element 42' inserting and holding therein and a cap ring 412 outwardly and radially protruded from the bottom edge of the cap body 411' and adapted for preventing the cap 41' from sliding out of the keyway 341'.

The resilient element 42' is adapted for applying an urging force against the cap 41' such that the cap 41' is adapted for bounding outwardly by the resilient element 42' within keyway 341'. The resilient element 42' can be made of magnetic conducting material so as to conduct all the magnet tumblers 32' to move inwardly to the locking position as shown in FIG. 8.

The returning means 40' is normally positioned inside the keyway 341' as shown in FIG. 8. The resilient element 42' will normally urge and retain the cap 41' toward the open end of the keyway 341' wherein the cap 41' will close the keyway 341' in order to prevent dust from outside for interfering and decreasing the magnetic field of the magnet lock assembly 10'. When the magnetic key 35' is inserted into the keyway 341' of the magnetic lock mechanism 10' as shown in FIG. 7, the resilient element 42' of the returning means 40' is being compressed. If the user does not rush and hold the magnetic key 35', the resilient element 42' will rebound to its original position and automatically push the magnet key 35' out of the keyway 341'. So, the magnetic key 35' will not accidentally remain in the magnetic lock cylinder 30'.

The features of the first and second embodiments and their alternative modes can be substituted each other or modified to fit the necessary.

Accordingly, for mass production of the magnetic lock mechanism 10 and the adequacy of the lock assembly industries, a maximum number of locking holes 331 are already radially distributed through a rotor wall of the lock rotor 33. Each magnet tumbler 32 can be selected its pole and located at the locking hole 331. So, one mold of the lock rotor 33 is manufactured and is adapted for thousands locking combinations by arranging the location and the pole of the magnet 353 in the magnetic lock cylinder 30.

Furthermore, a combination of the magnets 353 is preset in the magnet sockets 352 of the magnetic key 35, as shown in FIG. 1, for unlocking the corresponding combination of the magnet tumblers 32 in the magnetic lock mechanism 10. So, if there are two lock assemblies 10, two different combinations of the magnets 353 of the magnetic keys 35 are needed. The user may need to carry numbers of magnetic keys 35 to unlock the numbers of corresponding lock assemblies 10. Conveniently, the present invention provides a "master key" that all permutations and combinations of the magnets 353 are preset in one magnetic key 35 by combining the location and the pole of the magnets 353 set in the daughter keys and adapted for unlocking all the predetermined combinations of the magnetic lock mechanism 10.

Moreover, the magnetic lock mechanism 10 of the present invention provided more locking permutations and combinations to ensure the security function of a lock. For example, if there are four locking holes 331 on the rotor wall of the lock rotor 33 and each magnet tumbler 32 has two poles, there are sixteen (16*15*14* . . . *2*1) locking permutations and combinations for the magnetic lock mechanism 10. As the number of the locking holes 331 increases, the more combinations are able to be set. The present invention provides more than 600,000 of the locking combination so that the probability of the same locking permutation and combination should be almost impossible.

What is claimed is:

1. A magnetic lock mechanism, comprising:

a magnetic lock cylinder for actuating a latch assembly, wherein said magnetic lock cylinder comprises a lock sleeve, made of non-magnetic material, having an axial rotor hole and a plurality of tumbler sockets radially distributed on an inner surface of said lock sleeve;

a plurality of magnet tumblers, each of which has a north pole and a south pole at two ends respectively, being coaxially placed in said tumbler sockets respectively, wherein each of said magnet tumblers must equal to or shorter than said respective tumbler socket of said lock sleeve;

a tubular lock rotor, made of non-magnetic material, being rotatably and coaxially fitted in said axial hole of said lock sleeve, said lock rotor having an axial through hole and a plurality of locking holes distributed radially through a rotor wall thereof, wherein said locking holes are adapted for being coaxially aligned with said tumbler sockets respectively and each of said locking holes has a depth shorter than a length of said respective magnet tumbler; and a locker tube having a plurality of through slots axially provided thereon, made of magnetic conducting material such as iron and steel, being fittedly disposed inside said axial through hole of said lock rotor to define a keyway therethrough, wherein said locker tube is adapted for attracting said magnet tumblers inside said rotor hole to move inwardly towards said locking hole until an inner portion of each of said magnet tumblers is disposed in said respective locking hole and an outer portion of each of said magnet tumblers is disposed in said respective tumbler socket so as to lock up said rotatable movement between said lock rotor and said lock sleeve; and a magnetic key comprising a key body having a plurality of magnet sockets provided around said key body corresponding to said axial and radial positions of said magnet tumblers in said magnetic lock cylinder respectively, and a plurality of pill shaped magnets affixed in said magnet sockets respectively, wherein an outer end of each of said magnets has a magnetic pole equal to said magnet pole of said respective magnet tumbler, so that when said magnetic key is inserted into said keyway, said magnet tumblers are repelled radially outward into said tumbler sockets correspondingly, so as to unlock said magnetic lock cylinder to enable said lock rotor freely rotating to control said locking and unlocking of said latch assembly.

2. A magnetic lock mechanism, as recited in claim 1, wherein each of said through slots is aligned with said respective locking hole of said lock rotor wherein a size of each said through slot of said locker tube is larger than a diameter of said magnet tumblers such that said magnet tumblers are adapted for passing through said through slots respectively.

3. A magnetic lock mechanism, as recited in claim 1, wherein said locker tube comprises a plurality of ring-shaped tube members spacedly and coaxially aligned with each other and at least a supporting arm integrally connected between two tube members so as to define said through slot between two tube members.

4. A magnetic lock mechanism, as recited in claim 1, wherein said locker tube comprises a coil tube body integrally extended in a spiral manner such that said through slots are formed gaps between said coil tube body.

5. A magnetic lock mechanism, as recited in claim 1, wherein a maximum numbers of said through slot are already radially distributed through said locker tube so as to fit for all axial and radial locations of said magnet tumblers of said magnetic lock cylinder.

6. A magnetic lock mechanism, as recited in claim 2, wherein said magnetic lock cylinder further comprises an interior cover tube which is made of non-magnetic material is coaxially and fittedly disposed in said locker tube to define said keyway therethrough for securely covering said locker tube wherein said magnet tumblers are adapted for sitting on said interior cover tube by magnetically attracting said magnet tumblers with said locker tube through said through slots respectively.

7. A magnetic lock mechanism, as recited in claim 3, wherein said magnetic lock cylinder further comprises an interior cover tube which is made of non-magnetic material is coaxially and fittedly disposed in said locker tube to define said keyway therethrough for securely covering said locker tube wherein said magnet tumblers are adapted for sitting on said interior cover tube by magnetically attracting said magnet tumblers with said locker tube through said through slots respectively.

8. A magnetic lock mechanism, as recited in claim 4, wherein said magnetic lock cylinder further comprises an interior cover tube which is made of non-magnetic material is coaxially and fittedly disposed in said locker tube to define said keyway therethrough for securely covering said locker tube wherein said magnet tumblers are adapted for sitting on said interior cover tube by magnetically attracting said magnet tumblers with said locker tube through said through slots respectively.

9. A magnetic lock mechanism, as recited in claim 5, wherein said magnetic lock cylinder further comprises an interior cover tube which is made of non-magnetic material is coaxially and fittedly disposed in said locker tube to define said keyway therethrough for securely covering said locker tube wherein said magnet tumblers are adapted for sitting on said interior cover tube by magnetically attracting said magnet tumblers with said locker tube through said through slots respectively.

10. A magnetic lock mechanism, as recited in claim 6, wherein said magnetic key further comprises an exterior cover tube to securely and entirely cover said key body therein coaxially, so as to hidden locations of all said magnets affixed on said magnetic sockets from outside observation for security purpose.

11. A magnetic lock mechanism, as recited in claim 7, wherein said magnetic key further comprises an exterior cover tube to securely and entirely cover said key body therein coaxially, so as to hidden locations of all said magnets affixed on said magnetic sockets from outside observation for security purpose.

12. A magnetic lock mechanism, as recited in claim 8, wherein said magnetic key further comprises an exterior cover tube to securely and entirely cover said key body therein coaxially, so as to hidden locations of all said magnets affixed on said magnetic sockets from outside observation for security purpose.

13. A magnetic lock mechanism, as recited in claim 9, wherein said magnetic key further comprises an exterior cover tube to securely and entirely cover said key body therein coaxially, so as to hidden locations of all said magnets affixed on said magnetic sockets from outside observation for security purpose.

14. A magnetic lock mechanism, as recited in claim 6, wherein said magnetic lock cylinder further comprises a locating groove provided on an open end of said lock rotor, and correspondingly, a locating latch is outwardly protruded from an inner end of said key body of said magnetic key for fittedly engaging with said locating groove when said key body is inserted into said keyway for ensuring correct alignment of said magnets inside said magnetic key corresponding to said magnet tumblers in said magnetic lock cylinder.

15. A magnetic lock mechanism, as recited in claim 7, wherein said magnetic lock cylinder further comprises a locating groove provided on an open end of said lock rotor, and correspondingly, a locating latch is outwardly protruded from an inner end of said key body of said magnetic key for fittedly engaging with said locating groove when said key body is inserted into said keyway for ensuring correct alignment of said magnets inside said magnetic key corresponding to said magnet tumblers in said magnetic lock cylinder.

16. A magnetic lock mechanism, as recited in claim 8, wherein said magnetic lock cylinder further comprises a locating groove provided on an open end of said lock rotor, and correspondingly, a locating latch is outwardly protruded from an inner end of said key body of said magnetic key for fittedly engaging with said locating groove when said key body is inserted into said keyway for ensuring correct alignment of said magnets inside said magnetic key corresponding to said magnet tumblers in said magnetic lock cylinder.

17. A magnetic lock mechanism, as recited in claim 9, wherein said magnetic lock cylinder further comprises a locating groove provided on an open end of said lock rotor, and correspondingly, a locating latch is outwardly protruded from an inner end of said key body of said magnetic key for fittedly engaging with said locating groove when said key body is inserted into said keyway for ensuring correct alignment of said magnets inside said magnetic key corresponding to said magnet tumblers in said magnetic lock cylinder.

18. A magnetic lock mechanism, as recited in claim 6, further comprising a returning means for urging said magnetic key outwardly to prevent said magnetic key from remaining in said keyway, which comprises a cap having a diameter smaller than a diameter of said keyway and a resilient element normally urging and retaining said cap toward an open end of said keyway; said cap is adapted for sliding along said keyway and comprises a cap body wherein said resilient element adapted to insert and hold therein and a cap ring outwardly and radially protruded from a bottom edge of said cap body and adapted for preventing said cap from sliding out of said keyway.

19. A magnetic lock mechanism, as recited in claim 8, further comprising a returning means for urging said magnetic key outwardly to prevent said magnetic key from remaining in said keyway, which comprises a cap having a diameter smaller than a diameter of said keyway and a resilient element normally urging and retaining said cap toward an open end of said keyway; said cap is adapted for sliding along said keyway and comprises a cap body wherein said resilient element adapted to insert and hold therein and a cap ring outwardly and radially protruded from a bottom edge of said cap body and adapted for preventing said cap from sliding out of said keyway.

20. A magnetic lock mechanism, as recited in claim 9, further comprising a returning means for urging said magnetic key outwardly to prevent said magnetic key from remaining in said keyway, which comprises a cap having a diameter smaller than a diameter of said keyway and a resilient element normally urging and retaining said cap toward an open end of said keyway; said cap is adapted for sliding along said keyway and comprises a cap body wherein said resilient element adapted to insert and hold therein and a cap ring outwardly and radially protruded from a bottom edge of said cap body and adapted for preventing said cap from sliding out of said keyway.

* * * * *